US007025424B2

(12) United States Patent
Harley

(10) Patent No.: US 7,025,424 B2
(45) Date of Patent: Apr. 11, 2006

(54) CHAIR BACK FOR A CHAIR

(75) Inventor: Alexander Petrie Harley, Oakville (CA)

(73) Assignee: Allseating Corporation, Mississauga (CA)

( * ) Notice: Subject to any disclaimer, the term of this patent is extended or adjusted under 35 U.S.C. 154(b) by 0 days.

(21) Appl. No.: 10/861,370

(22) Filed: Jun. 7, 2004

(65) Prior Publication Data

US 2005/0269848 A1 Dec. 8, 2005

(51) Int. Cl.
*A47C 31/00* (2006.01)
*A47C 7/02* (2006.01)

(52) U.S. Cl. ..... 297/452.63; 297/452.56; 297/219.1

(58) Field of Classification Search ..... 297/296, 297/301.1, 301.3, 452.64, 452.63, 452.56, 297/228.1, 219.1, 284.5, 440.11
See application file for complete search history.

(56) References Cited

U.S. PATENT DOCUMENTS 2,309,881 A * 2/1943 Wise ..... 297/296
2,722,967 A * 11/1955 Reinholz ..... 297/270.3
4,230,365 A 10/1980 Messinger
5,207,478 A * 5/1993 Freese et al. ..... 297/296
5,393,126 A * 2/1995 Boulva ..... 297/452.56
5,887,945 A * 3/1999 Sedlack ..... 297/296
6,050,646 A * 4/2000 Stenzel et al. ..... 297/452.59
6,120,097 A 9/2000 Perry et al.
6,478,381 B1 * 11/2002 Cramb et al. ..... 297/452.13
6,508,509 B1 1/2003 Peterson
6,666,509 B1 * 12/2003 Matsushima ..... 297/219.1
6,669,294 B1 * 12/2003 Kinoshita et al. ..... 297/354.1
6,698,839 B1 * 3/2004 Ballendat ..... 297/440.11
6,729,691 B1 * 5/2004 Koepke et al. ..... 297/452.56
6,811,215 B1 * 11/2004 Horiki et al. ..... 297/228.1
2003/0151287 A1 * 8/2003 Ueda et al. ..... 297/301.1

* cited by examiner

*Primary Examiner*—Peter M. Cuomo
*Assistant Examiner*—Sarah B. McPartlin
(74) *Attorney, Agent, or Firm*—Miller Thomson LLP

(57) ABSTRACT

A chair back for a chair that includes a support frame portion having a defined shape and is adapted to attach to a chair base member. The chair back for a chair may also include a tensioning frame portion having a defined shape and a removable elastomeric support sleeve having an opening adapted to receive the defined shape of the support frame portion and the defined shape of the tensioning frame portion. The removable elastomeric support sleeve may be slid first over the support frame portion so as to conform the removable elastomeric support sleeve to the defined shape of the support frame portion. The removable elastomeric support sleeve may then be slid second over the tensioning frame portion thereby conforming the elastomeric support sleeve to the defined shape of the tensioning frame portion. The support frame portion may be adapted to receive and secure the tensioning frame portion, so that the force of connecting the tensioning portion to the support frame portion locks the defined shape of the support frame portion and the defined shape of the tensioning frame portion to one another along with the removable elastomeric support sleeve and therefore forms the chair back.

11 Claims, 4 Drawing Sheets

CHAIR BACK FOR A CHAIR

FIELD OF THE INVENTION

This invention relates in general to chair backs and more particularly to a chair back for a chair having a frame and a removable mesh knitted sock or sleeve that can accommodate different shaped backs and is held in place on the chair frame via the tension within the knitted sock and the structure of the chair frame therefore not requiring fasteners.

BACKGROUND OF THE INVENTION

Chair backs have traditionally included components such as wood or metal supports, some form of padded composite, and upholstery, so as to form a chair back that then provides support as well as a pleasing look. Typically a chair back has included a support frame that can be a rigid panel, followed by padding or stuffing that is then covered by fabric. The fabric can be positioned and secured a number of ways to support the frame. The support frame defines the shape of the chair back and can be a wide variety of shapes. The shape of the chair back however has to be sufficient so that there is sufficient support in the middle of the chair back for the user to lean against. The top of the chair back can be narrower or wider than the middle of the chair, but traditionally the bottom portion of the chair is the same width as the middle portion of the chair back.

The usual assembly of the chair back requires the fabric to be pulled over the padding or stuffing like a sleeve, pocket or soc that is shaped to the general shape of the chair back and is open at one end, usually the bottom end. Therefore the sleeve opening is fit over the top end of the chair back and then pulled down over the middle portion of the chair back to the bottom portion. The open end of the sleeve is then closed by stapling or fastening the ends of the sleeve to the bottom portion of the chair. This is usually facilitated by having a piece of wood mounted to the bottom of the chair back so that stapling of the fabric can be done fairly expeditiously. As such, there are limitations as to the shape of the bottom portion of the chair back so as to avoid either having excess material at the bottom portion of the chair or not being able to fit the sleeve over the middle portion of the chair back if the bottom portion was smaller or narrower than the middle portion.

Prior art chair backs have been devised to address some of the aforenoted problems of attaching fabric to a support frame for a chair. For example, U.S. Pat. No. 6,120,097 issued on Sep. 19, 2000 to Perry et al. and relates to a flexible chair which includes a seat frame having a bidirectional fabric stretched over the seat frame to define seat back and seat bottom portions. The seat frame is supported on an upper axis and a lower axis by a flexible frame. The fabric cover 116 is preferably a single piece of bidirectional mesh fabric, such as high density two-way stretch woven cloth. The fabric may be cut to appropriate size, then the seat frame 110 inserted as components into openings or pockets provided in the sewn fabric pattern and completed as described below. Alternatively, the fabric may be stretched over the completed seat frame and heated to shrink the fabric to the frame using well known techniques. Referring to FIG. 5, the seat frame 110 is preferably constructed by assembling front section 111, mid-sections 112L and 112R, and top section 114, after insertion of these sections into pockets sewn into the fabric cover. These sections are preferably five-eighths inch steel tube 101, formed or bent to shape. As shown in FIG. 6A, front section 111 preferably includes a support bar

111*a* attached to the middle of section 111, for example, by weldment, to provide additional support against sagging of the fabric cover 116. Support bar 111*a* can be a smaller diameter steel, for example, three-eighths inch. As shown in FIG. 6B, each section of tube 101 is inserted into a corresponding pocket 102 formed in the fabric cover 116A, for example, by wrapping the fabric and sewing on seam 103, as shown. The location of seam 103 is left to design preference, but if left out from the end about five or six inches, then pockets are formed which are suitable to accommodate foam inserts, or support bar 111*a*.

U.S. Pat. No. 5,393,126 which issued on Feb. 28, 1995 to Boulva and relates to a composite support frame structure for the construction of a seat. The support structure comprises a rigid continuous rod-like frame formed in a closed loop and having opposed diverging rod-like side members which lie in a common plane and opposed rod-like end members formed integral with the side members. At least one of the end members is arced outwardly. A belt of substantially non-extensible material forms a slightly truncated sleeve, narrower that the frame, to apply a compression force between the side members and to flex the arced end member. The sleeve is retained in tension about the opposed diverging rod-like side members by restoring spring force between the side members exerted by the arced end member.

U.S. Pat. No. 4,230,365 which issued on Oct. 28, 1980 to and relates to Messinger an article of furniture, and a method for making same, the furniture comprising a self-supporting peripheral frame, having an open central region, and a fabric sleeve, covering said peripheral frame and providing a body support surface. The peripheral frame, which comprises two side rail members and a plurality of braces connecting the rail members, defines a body contour. The fabric sleeve may be impregnated with a resinous material, thereby providing a substantially rigid body support surface, or padding may be disposed between the fabric sleeve and the peripheral frame, thereby providing a softer body support surface. The fabric sleeve may be a one-piece, two-way stretch member, such as different types of knitted materials or a non-stretch member of different types of woven materials. The article of furniture may be formed as a chair, a lounger or recliner or a foot rest. The articles of furniture are easily shaped in keeping with the requirements of the human body by stretching the fabric over a designed contour, thereby providing an inexpensive means for producing customized furniture on a large scale.

U.S. Pat. No. 6,508,509 which issued on Jan. 21, 2003 to Peterson and relates to a seating unit illustrated as a mobile office chair includes a base, a back upright operably supported on the base for reclining movement and a back construction. The back construction includes a cushion assembly attached to a back support shell with quick-attach top and bottom connectors. Specifically, the back support shell includes top apertures, and the cushion assembly includes hooks for drop-in attachment to the top apertures. The back support shell also includes a molded bottom section defining a recess, and the back cover includes a stiffened edge flange configured to frictionally engage the recess to retain the back cover to the back support. The cushion assembly includes a cover assembly with an upholstered front panel, and a rear panel formed by a first sheet section having a one-directional stretch in a vertical direction, and a second section having a high-stretch property.

U.S. Pat. No. 6,478,381 which issued on Nov. 12, 2002 to Cramb, III et al. and relates to a vehicle seat assembly is provided having a seat bottom and a seat back assembly connected to the seat bottom. The seat back assembly includes a support frame having a pair of opposing substantially vertical side frame members which receive an elastomeric support webbing. The elastomeric support webbing extends between the opposing substantially vertical side frame members to provide structural support for the passenger of a vehicle. Side bolsters are attached to the elastomeric support webbing about the opposing substantially vertical side frame members. A headrest or upper bolster is secured to the top of the frame of the seat assembly adjacent the side bolsters.

Prior art chair backs or support devices however do not address issues of attaching fabric to a support frame without fasteners, while applying the fabric to a variety of different shaped backs. More specifically prior art devices do not address the ability for attaching a fabric on to a chair back that is shaped identically at both the top and bottom of the chair back therefore not requiring that the bottom of the chair back be a place for the attachment of the fabric. Typically prior art devices can accommodate a chair back that may be narrow at the top but not at the bottom since the pocket of fabric would either not fit over the middle portion of the chair or the fabric would be able to fit over the middle portion of the chair but sag around a narrow bottom portion. Thus a mesh chair back having a frame and a removable sleeve that can accommodate different shaped backs and is held in place on the chair frame via the tension within the knitted sock and the structure of the chair frame and not requiring fasteners which is desirable.

SUMMARY OF THE INVENTION

An object of one aspect of the present invention is to provide an improved chair back for a chair having a frame and a removable mesh knitted pocket or sleeve that can accommodate different shaped backs and is held in place on the chair frame via the tension within the knitted sock and the structure of the chair frame therefore not requiring fasteners.

In accordance with one aspect of the present invention there is provided a chair back for a chair that includes a support frame portion having a defined shape and is adapted to attach to a chair base member. The chair back for a chair may also include a tensioning frame portion having a defined shape and a removable elastomeric support sleeve having an opening adapted to receive the defined shape of the support frame portion and the defined shape of the tensioning frame portion. The removable elastomeric support sleeve may be slid first over the support frame portion so as to conform the removable elastomeric support sleeve to the defined shape of the support frame portion. The removable elastomeric support sleeve may then be slid second over the tensioning frame portion thereby conforming the elastomeric support sleeve to the defined shape of the tensioning frame portion. The support frame portion may be adapted to receive and secure the tensioning frame portion, so that the force of connecting the tensioning portion to the support frame portion locks the defined shape of the support frame portion and the defined shape of the tensioning frame portion to one another along with the removable elastomeric support sleeve and therefore forms the chair back.

Conveniently, the opening of the removable elastomeric support sleeve is positioned at a point on the removable elastomeric support sleeve which has the greatest width. The defined shapes of the support frame portion and the tensioning frame portion may be mirror images of themselves or tensioning frame portion may be larger in size.

Furthermore a method of assembling a chair back for a chair is provided and includes sliding a removable elastomeric support sleeve having an opening over a support frame portion having a defined shape and adapted to attach to a chair base member of the chair. Conforming the removable elastomeric support sleeve to the defined shape of the support frame portion. Sliding the removable elastomeric support sleeve over a tensioning frame portion having a defined shape. Conforming the removable elastomeric support sleeve to the defined shape of the tensioning frame portion. Locking the tensioning frame portion to the support frame portion as the support frame portion is adapted to receive and secure the tensioning frame portion. Tensioning the removable elastomeric support sleeve from the force of connecting the tensioning frame portion to the support frame portion thereby forming the chair back.

Advantages of the present invention are: the arrangement of the removable elastomeric support sleeve with the support frame portion and the tensioning frame portion allows for the chair back to be a variety of shapes; no fasteners or mechanical attachments are required for attaching the removable elastomeric support sleeve to the frame portions; trim and/or covers are not required to hide fasteners; the elastomeric support sleeve is easily removable to change colour; easy to install in the field and for servicing; the tensioning and support frame portions can be shaped into various design chair backs; the defined shapes of the support frame and tensioning frame portions can be made from a variety of material such as metal tubing so long as the two frame portions can fit together; the removable elastomeric support sleeve may be shaped to accommodate both the tensioning frame portion and the support frame portion via an opening that is conveniently positioned at the widest point on the chair back shape and can accommodate a removable lumbar support; the tensioning of the removable elastomeric support sleeve for the chair back occurs automatically as soon as the tensioning frame portion and the support frame portion are locked together; and the structure of the support frame portion allows for support for the chair back to occur all the way to the mid-point of the chair back rather than from the chair base member thereby allowing the structure of the support frame portion to be partially made from a thinner tubing and therefore result in a thinner profile.

BRIEF DESCRIPTION OF THE DRAWINGS

A detailed description of the preferred embodiment is provided herein below by way of example only and with reference to the following drawings, in which.

Figure 1A:
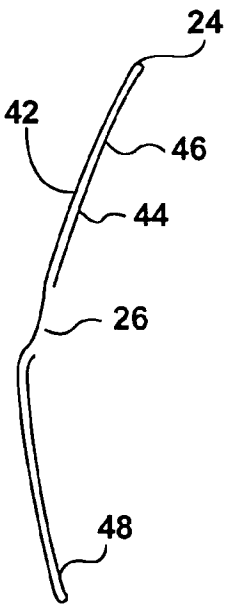
FIG. 1A in a side view, illustrates the removable elastomeric support sleeve of the chair back of FIG. 1.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 1:
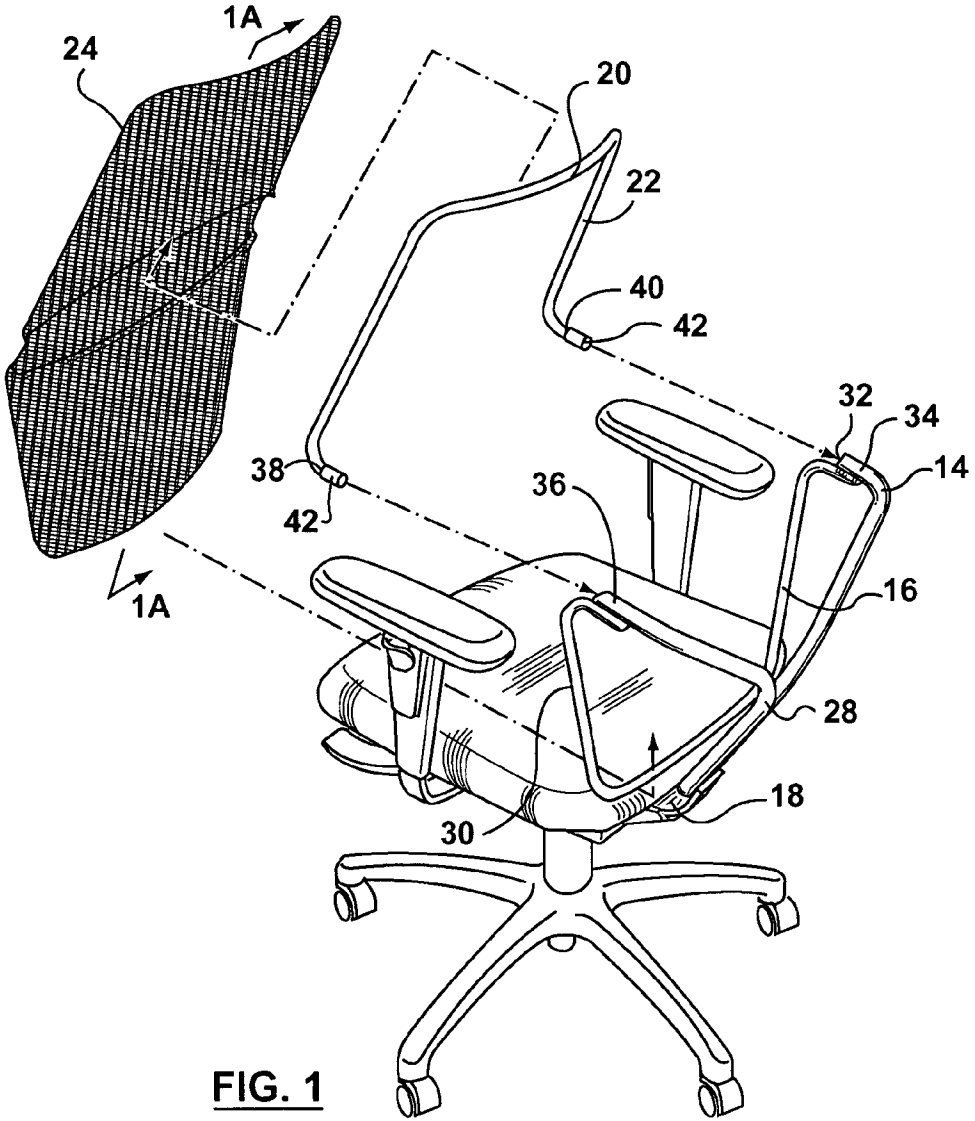
FIG. 1 in a partial exploded view, illustrates a chair back for a chair in accordance with the preferred embodiment of the present invention.
Figure 3:
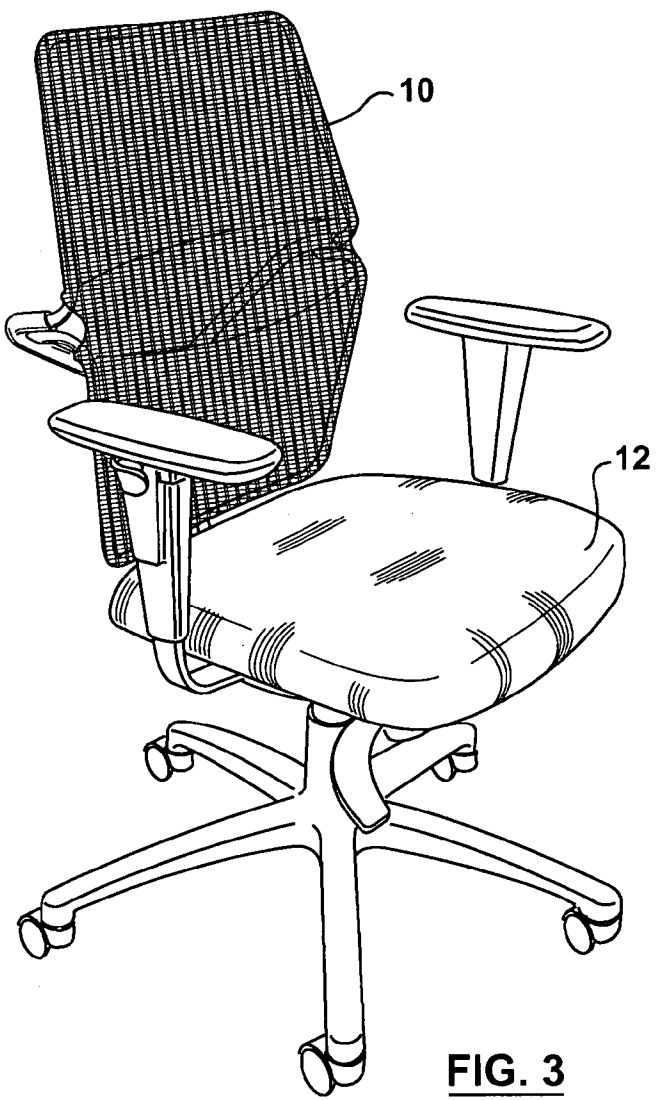
FIG. 3 in a perspective view, illustrates the chair back of FIG. 1.

Referring to FIGS. 1, and 3 there is illustrated in perspective views, a chair back 10 for a chair 12 in accordance with a preferred embodiment of the present invention. The chair back 10 for a chair 12 includes a support frame portion 14 having a defined shape 16 and is adapted to attach to a chair base member 18. The chair back 10 for the chair 12 may also include a tensioning frame portion 20 having a defined shape 22 and a removable elastomeric pocket or support sleeve 24 having an opening 26 adapted to receive the defined shape 16 of the support frame portion 16 and the defined shape 22 of the tensioning frame portion 20.

Figure 4:
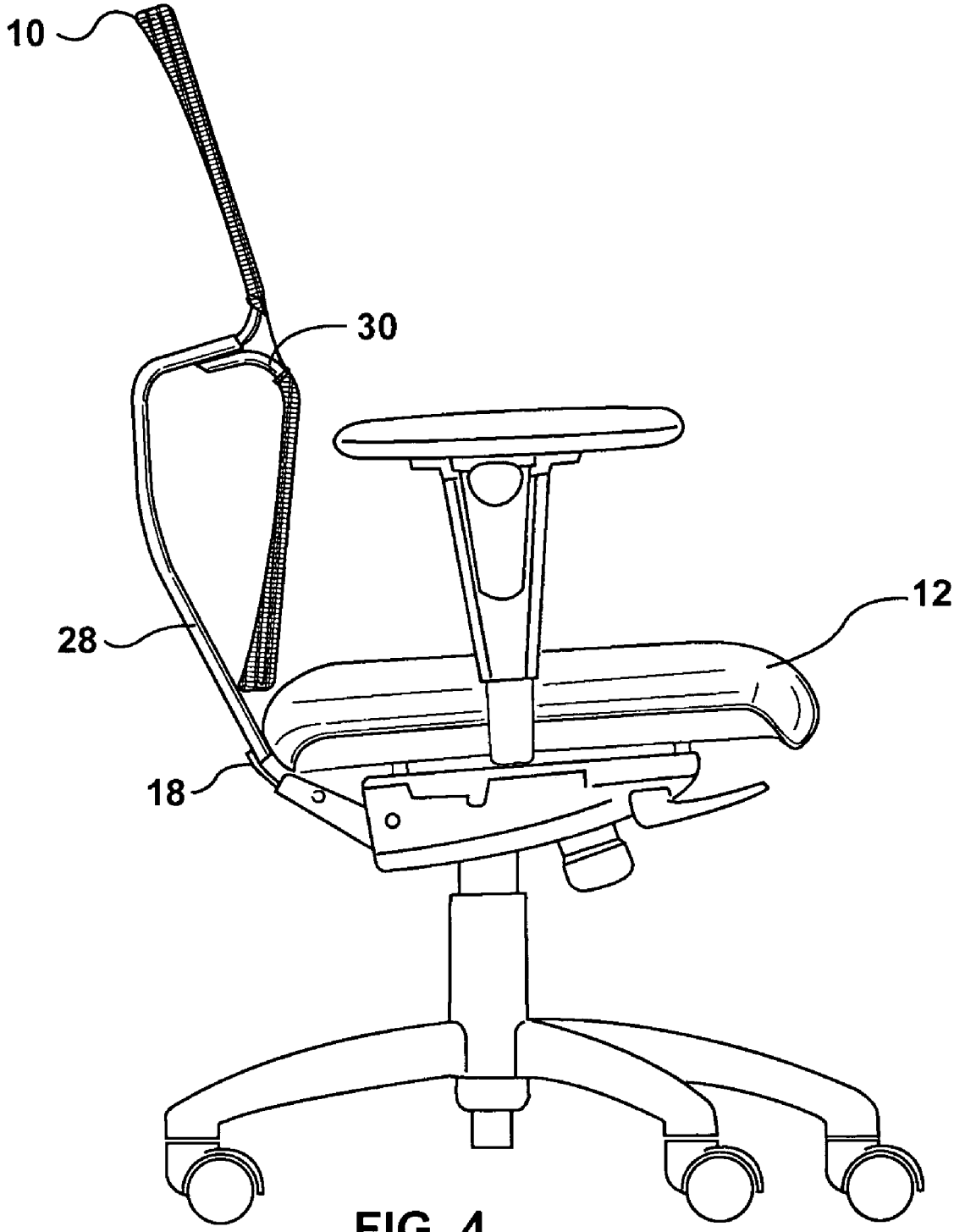
FIG. 4 in a side elevation view, illustrates the chair back of FIG. 1.
Figure 6:
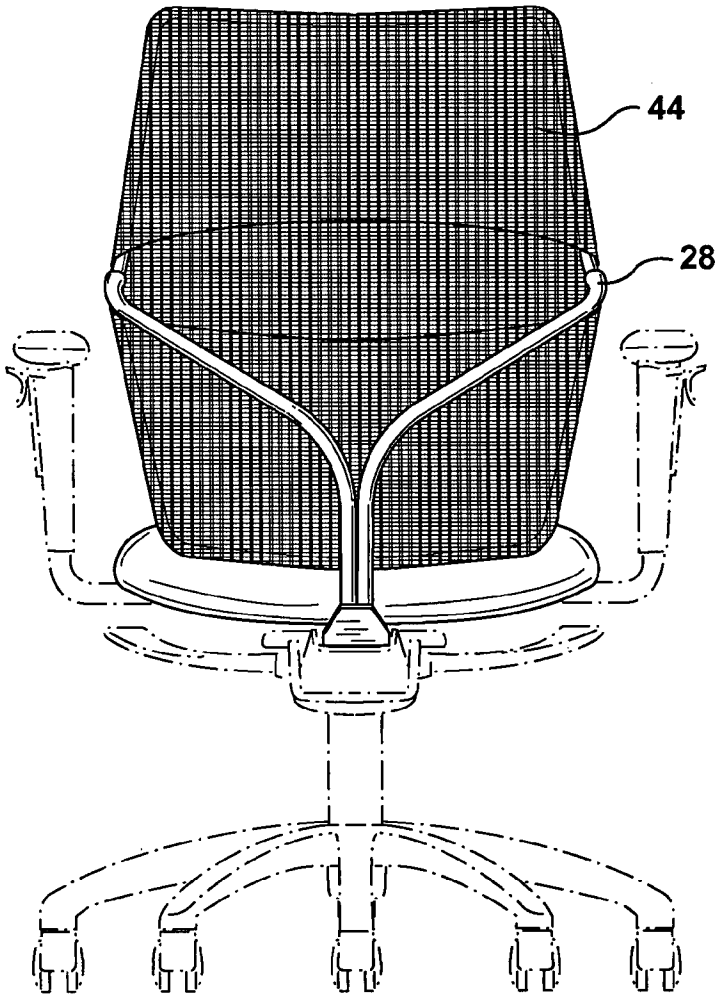
FIG. 6 in a back elevation view, illustrates the chair back of FIG. 1.

Referring to FIGS. 1 and 6 the support frame portion 14 may be further defined to include a Y-shaped portion 28 that attaches the support frame portion 14 to the chair base member 18, and a support member 30 that is mounted to the Y-shaped portion 28. The support member 30 engages the removable elatomeric support sleeve 24 when the chair back 10 is assembled. The positioning of the Y-shaped portion 28 allows the chair back 10 to have support beyond the chair base member 18 and up to at least the mid-point of the chair back 10. This advantageous positioning provides extra structure to the chair back 10 and therefore allows for the support member 30 to be a thinner structure which in turn enhances the profile of the chair 12. In general the Y-shaped portion 28 may be made from hollow metal tubing that is shaped to provide two openings 32 at first and second ends 34 and 36 respectively of the Y-portion 28. In general the support member 30 may be made from metal tubing that is generally smaller in diameter than the tubing used for the Y-shaped portion 28 so as to provide a thinner profile to chair back 10 (FIG. 4). The support member 30 to attached to the Y-shaped portion 28 via well know methods in the art such as welding.

Referring to FIG. 1, the tensioning frame portion 20 may be further defined as having a first end 38 and a second end 40 which are adapted to fit into the two opening 32 at the first and second ends 34 and 36 of the Y-shape portion 28. More specifically the first end 38 and second end 40 may further include rubber bushings 42 to provide a friction fit of the tensioning frame portion 20 into the support frame portion 14. The support frame portion 14 and the tensioning frame portion 20 may made from a variety of appropriate materials, like metal or composites and the like as long as the ends 38 and 40 of the tensioning frame portion fit into the two opening 32 of the support frame portion 14.

Figure 2:
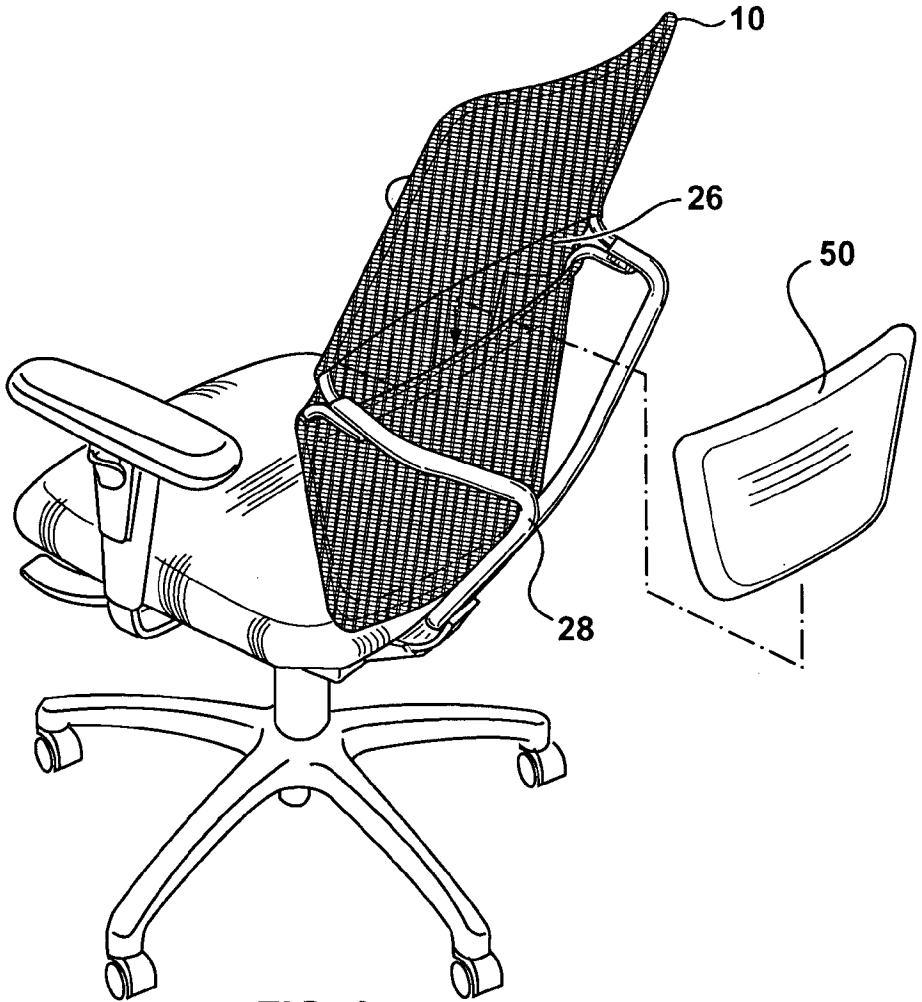
FIG. 2 in a back perspective view, illustrates the chair back showing the insertion of the lumbar support of FIG. 1.
Figure 5:
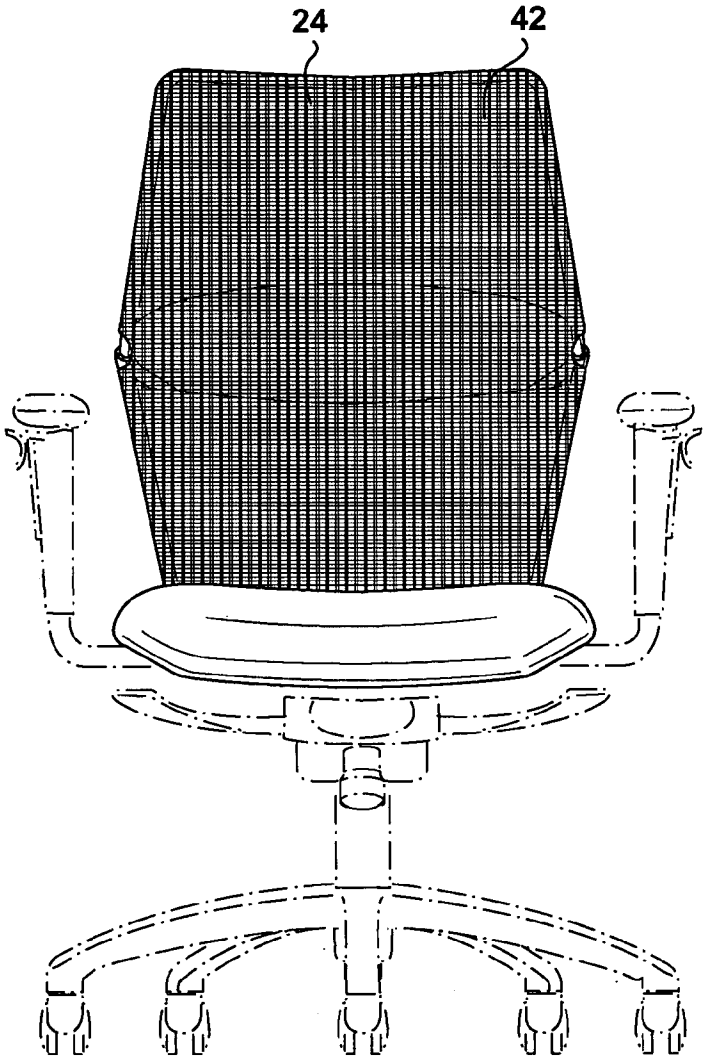
FIG. 5 in a front elevation view, illustrates the chair back of FIG. 1.

Referring to FIGS. 1A and 5 the removable elastomeric support sleeve 24 may have front side 42, a back side 44, a top region 46 and a bottom region 48 and may be shaped in a variety of shapes to accommodate the defined shapes 16 and 22 of the support frame portion 14 and the tensioning frame portion 20. More specifically the opening 26 must be positioned at the point on the removable elastomeric support sleeve 24 that is the widest on the shape of the removable elastomeric support sleeve 24. The positioning of the opening 26 at the widest point ensures that the elastomeric support sleeve 24 will fit over either the defined shape 16 of the support frame portion 14 or the defined shape 22 of the tensioning frame portion 20. This configuration allows the defined shapes 16 or 22 to be individually any shape, such as the defined shape 16 for the support frame portion 14 being smaller or larger than the defined shape 22 of the tensioning frame portion 20, the same shape (mirror image of one another), or completely different from one another. Therefore the chair back 10 has limitless possibilities of designs or shapes. Finally the removable elastomeric support sleeve 24 may be an elastomeric mesh that provides support. Furthermore a removable lumbar support or pillow 50 (FIG. 2) may be inserted though the opening 26 and positioned accordingly.

The method of assembling the chair back 10 is provided. First the bottom region 48 of the removable elastomeric support sleeve 24 may be slid first over the support frame portion 14 so as to conform the removable elastomeric support sleeve 24 to the defined shape 16 of the support frame portion 14. More specifically the support member 30 may be slid through the opening 26 on the back side 44 of the elastomeric support sleeve 24. The tensioning frame portion 20 may then be slid into the top region 46 of the removable elastomeric support sleeve 24 thereby conforming the elastomeric support sleeve 24 to the defined shape 22 of the tensioning frame 20. The first and second ends 38 and 40, of the tensioning frame 20 may then be inserted into the openings 32 of the support frame portion 14. The force or pressure of connecting the tensioning frame portion 20 to the support frame portion 14 locks the defined shape 16 of the support frame portion 14 and the defined shape 22 of the tensioning frame portion 20 to one another. Furthermore the removable elastomeric support sleeve 24 is automatically tensioned both vertically and horizontally across both the tensioning frame portion 20 and the support frame portion 14, thereby forming the chair back 10.

The assembled chair back 10 does not require any fasteners or mechanical attachments to keep the removable elastomeric support sleeve 24 in place. Therefore there is no need for upholstery type trim or covering to hide traditional fasteners that are usually required to hold the fabric or upholstery in place. Furthermore the pressure or force to lock the tensioning frame portion 20 and the support frame portion 14 together keeps the chair back 10 from disassembling and keeps the removable elastomeric support sleeve 24 in place. Finally the chair back 10 configuration allows for easy instalment and assembly in the field.

Other variations and modifications of the invention are possible. All such modifications or variations are believed to be within the sphere and scope of the invention as defined by the claims appended hereto.

I claim:

1. A chair back for a chair, comprising:

(b) a support frame portion having a defined shape said defined shape having a wider top portion than a bottom portion and said bottom portion adapted to attach to a chair base member of said chair;

(c) a tensioning frame portion having a defined shape; and (d) a removable elastomeric support pocket having a front side, a back side, a top region and a bottom region and an opening spanning across the width of the back side and adapted to receive said defined shape of said support frame portion and said defined shape of said tensioning frame portion;

wherein said removable elastomeric support pocket is first slid over said support frame portion thereby conforming said removable elastomeric support pocket to said bottom portion and then said top portion of said support frame portion, and said removable elastomeric support pocket is slid second over said tensioning frame portion thereby conforming said removable elastomeric support pocket to said defined shape of said tensioning frame portion, and wherein said support frame portion is adapted to receive and secure said tensioning frame portion wherein the connecting of said tensioning frame portion to said support frame portion with said removable elastomeric support pocket provides tension to form said chair back.

2. A chair back for a chair as claimed in claim 1 wherein said opening of said removable elastomeric support pocket is positioned on the back of said removable elastomric support pocket at a point on said removable elastomeric support pocket which has the greatest width.

3. A chair back for a chair as claimed in claim 2 wherein said defined shape of said tensioning frame portion has a first end and a second end.

4. A chair back for a chair as claimed in claim 3 wherein said defined shaped of said support frame portion further comprises a first end and second end, each end having an openings for receiving said first and second ends of said tensioning frame portion respectively.

5. A chair back for a chair as claimed in claim 4 wherein said first and second ends of said tensioning frame portion further comprise rubber bushings for friction fitting said tensioning frame portion into said openings of said support frame portion.

6. A chair back for a chair as claimed in claim 5 wherein said support frame portion has a Y-shaped portion attached to said chair base member.

7. A chair back for a chair as claimed in claim 6 wherein said defined shapes of said support frame portion and said tensioning frame portion are made from tubing.

8. A chair back for a chair as claimed in claim 2 wherein said defined shape of said tensioning frame portion is a mirror image of said defined shape of said support frame portion.

9. A chair back for a chair as claimed in claim 2 wherein said defined shape of said tensioning frame portion is larger than said defined shape of said support frame portion.

10. A chair back for a chair as claimed in claim 2 wherein said removable elsatomeric support sleeve further comprises a removable lumbar support inserted through said opening.

11. A chair back for a chair as claimed in claim 1 wherein said removable elastomeric support pocket is a removable elastomeric support mesh sleeve.

* * * * *